US007891529B2

(12) United States Patent
Paas et al.

(10) Patent No.: US 7,891,529 B2
(45) Date of Patent: Feb. 22, 2011

(54) TRIGGER ACTUATOR FOR AEROSOL CONTAINER TO AID IN ACTUATING SAME

(75) Inventors: Edward L. Paas, Los Altos, CA (US); Thomas S. Scott, Cincinnati, OH (US); John E. O'Dom, Cincinnati, OH (US); Lawrence J. Kelly, Fairfield, OH (US); William W. Wichman, Cincinnati, OH (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 12/575,956

(22) Filed: Oct. 8, 2009

(65) Prior Publication Data

US 2010/0019001 A1 Jan. 28, 2010

Related U.S. Application Data

(62) Division of application No. 11/057,018, filed on Feb. 11, 2005, now Pat. No. 7,631,785.

(51) Int. Cl.
*B65D 83/00* (2006.01)

(52) U.S. Cl. ..... 222/402.15; 222/1; 222/182; 222/402.13

(58) Field of Classification Search ..... 222/182, 222/402.1, 402.15, 402.13, 402.21, 402.22, 222/402.23, 402.24, 402.25, 151, 183, 325, 222/1

See application file for complete search history.

(56) References Cited

U.S. PATENT DOCUMENTS

| | | | | |
|---|---|---|---|---|
| 2,360,603 | A | | 10/1944 | Ward |
| D152,645 | S | | 2/1949 | Nurkiewicz |
| 2,691,548 | A | | 10/1954 | Feucht et al. |
| 3,045,878 | A | | 7/1962 | Blanford et al. |
| 3,138,331 | A | | 6/1964 | Kutik |
| 3,146,916 | A | | 9/1964 | Kronheim |
| 3,149,761 | A | | 9/1964 | Harris et al. |
| 3,174,659 | A | | 3/1965 | Sorber et al. |
| 3,209,949 | A | | 10/1965 | Gurtler |
| 3,227,321 | A | | 1/1966 | Sagarin |
| 3,260,416 | A | | 7/1966 | Abplanalp |
| 3,347,423 | A | * | 10/1967 | Babbin et al. ..... 222/183 |
| 3,428,224 | A | | 2/1969 | Eberhardt et al. |

(Continued)

FOREIGN PATENT DOCUMENTS

| | | |
|---|---|---|
| CH | 00 620 602 | 12/1980 |

(Continued)

OTHER PUBLICATIONS

Int'l Search Report and Written Opinion Appl. No. PCT/US2006/004560 dated Jun. 21, 2006.

*Primary Examiner*—Frederick C. Nicolas

(57) ABSTRACT

A trigger actuator for a container includes a recess defined by one or more walls that protrude downwardly surrounding an actuating button of an overcap of the container, wherein the trigger actuator is attached to the actuating button. The trigger actuator further includes an aperture disposed in the recess above an outlet in the actuating button and a lever disposed on a side of the trigger actuator. Pressing the lever towards the container forces the walls defining the recess downward displacing the actuating button.

17 Claims, 4 Drawing Sheets

U.S. PATENT DOCUMENTS

| | | | | | |
|---|---|---|---|---|---|
| 3,429,484 | A | | 2/1969 | Baldwin | |
| D218,145 | S | | 7/1970 | Doblin | |
| D219,333 | S | | 12/1970 | Doblin | |
| 3,580,432 | A | | 5/1971 | Brooks | |
| 3,648,905 | A | | 3/1972 | Kauder | |
| 3,888,392 | A | * | 6/1975 | Van Coney | 222/108 |
| 3,913,805 | A | | 10/1975 | Sette | |
| 3,934,761 | A | * | 1/1976 | Gentreau | 222/183 |
| 3,958,726 | A | * | 5/1976 | Trotta | 222/402.13 |
| 3,987,942 | A | | 10/1976 | Morane et al. | |
| 4,053,086 | A | * | 10/1977 | DeBard | 222/182 |
| 4,053,090 | A | * | 10/1977 | Kelly et al. | 222/402.13 |
| 4,077,549 | A | | 3/1978 | Beard | |
| 4,132,359 | A | | 1/1979 | Nozawa | |
| 4,141,471 | A | * | 2/1979 | Nozawa et al. | 222/182 |
| 4,187,963 | A | * | 2/1980 | Mascia | 222/402.13 |
| 4,264,037 | A | | 4/1981 | Nozawa | |
| 4,333,589 | A | | 6/1982 | Bush | |
| 4,449,647 | A | | 5/1984 | Reed et al. | |
| 4,506,808 | A | * | 3/1985 | Goncalves | 222/182 |
| D291,415 | S | | 8/1987 | Abplanalp | |
| 4,771,769 | A | | 9/1988 | Hegemann et al. | |
| 4,773,571 | A | | 9/1988 | Hagan et al. | |
| 4,805,839 | A | | 2/1989 | Malek | |
| D301,205 | S | | 5/1989 | Joyaux et al. | |
| 4,826,054 | A | | 5/1989 | Frutin | |
| 4,901,891 | A | | 2/1990 | Goncalves | |
| D307,648 | S | | 5/1990 | Arrington | |
| D314,237 | S | | 1/1991 | Blumanthal, Jr. | |
| D316,959 | S | | 5/1991 | Battegazzore | |
| 5,018,647 | A | | 5/1991 | Abplanalf | |
| 5,040,705 | A | | 8/1991 | Snell | |
| D333,778 | S | | 3/1993 | Magidson et al. | |
| D337,054 | S | | 7/1993 | Chong | |
| D338,615 | S | | 8/1993 | Magidson et al. | |
| 5,249,713 | A | | 10/1993 | Reich et al. | |
| 5,316,185 | A | | 5/1994 | Meenan | |
| D349,642 | S | | 8/1994 | Abfier | |
| 5,358,147 | A | * | 10/1994 | Adams et al. | 222/183 |
| 5,370,313 | A | | 12/1994 | Beard | |
| D378,802 | S | | 4/1997 | Corcoran | |
| 5,702,036 | A | | 12/1997 | Ferrara, Jr. | |
| 5,862,960 | A | * | 1/1999 | Miller et al. | 222/325 |
| D405,008 | S | | 2/1999 | Irwin et al. | |
| 5,875,934 | A | * | 3/1999 | Miller et al. | 222/183 |
| 5,992,707 | A | | 11/1999 | Gaichuk | |
| 5,992,708 | A | | 11/1999 | Gaichuk | |
| 6,006,957 | A | | 12/1999 | Kunesh | |
| 6,161,736 | A | | 12/2000 | Kaufman et al. | |
| D436,038 | S | | 1/2001 | Ruiz de Gopegui | |
| D448,535 | S | | 9/2001 | Delmerico | |
| 6,325,256 | B1 | | 12/2001 | Liljeqvist et al. | |
| 6,474,510 | B2 | | 11/2002 | Frutin | |
| 6,494,349 | B1 | | 12/2002 | Thompson et al. | |
| D476,558 | S | | 7/2003 | Cho et al. | |
| 6,607,106 | B2 | | 8/2003 | Henry et al. | |
| 6,637,627 | B1 | | 10/2003 | Liljeqvist et al. | |
| 6,685,064 | B2 | | 2/2004 | Frutin | |
| 6,705,494 | B2 | | 3/2004 | Thompson et al. | |
| 6,722,532 | B2 | | 4/2004 | Lasserre et al. | |
| D489,970 | S | | 5/2004 | Nelson et al. | |
| D489,980 | S | | 5/2004 | Shurtleff et al. | |
| D490,699 | S | | 6/2004 | Nelson et al. | |
| D497,808 | S | | 11/2004 | Morris et al. | |
| 6,820,777 | B2 | | 11/2004 | Frutin | |
| 6,874,663 | B2 | | 4/2005 | Scheindel | |
| 6,918,516 | B2 | | 7/2005 | Frutin | |
| 6,964,381 | B2 | | 11/2005 | Stradella et al. | |
| 7,124,916 | B2 | * | 10/2006 | Groh et al. | 222/402.13 |
| 7,631,785 | B2 | * | 12/2009 | Paas et al. | 222/182 |
| 2002/0030067 | A1 | | 3/2002 | Frutin | |
| 2003/0015191 | A1 | | 1/2003 | Armstrong et al. | |
| 2003/0052137 | A1 | | 3/2003 | Frutin | |
| 2003/0075571 | A1 | | 4/2003 | Thompson et al. | |
| 2004/0188473 | A1 | | 9/2004 | Groh et al. | |
| 2004/0222245 | A1 | | 11/2004 | Marroncles | |
| 2004/0222246 | A1 | | 11/2004 | Bates et al. | |
| 2004/0256418 | A1 | | 12/2004 | Scheindel | |
| 2005/0011914 | A1 | | 1/2005 | Frutin | |
| 2005/0045664 | A1 | | 3/2005 | Taylor | |
| 2005/0178802 | A1 | | 8/2005 | Groh et al. | |
| 2005/0224525 | A1 | | 10/2005 | Davies | |

FOREIGN PATENT DOCUMENTS

| | | |
|---|---|---|
| CH | 000 639 621 | 11/1983 |
| DE | 1 961 0456 | 9/1997 |
| EP | 0 096 402 | 12/1983 |
| EP | 1 201 318 | 5/2002 |
| GB | 1 429 403 | 3/1976 |
| GB | 2 218 471 | 11/1989 |
| GB | 2 297 586 | 8/1996 |
| IT | 1028195 | 1/1979 |
| IT | 1028196 | 1/1979 |
| JP | 2001286796 | 10/2001 |
| JP | 2003034374 | 2/2003 |
| WO | WO 96/11151 | 4/1996 |
| WO | WO 99/18010 | 4/1999 |

* cited by examiner 10
12
14
16
18
19
20
21
22
24
26
28

58
54
44
48
52
56
50
46

10
14
18
46
48
56
12
54
50
44

14
10
12
44
54
48
56
50

58
54
18
14
10
12
44
48
52
50
56
19
46

TRIGGER ACTUATOR FOR AEROSOL CONTAINER TO AID IN ACTUATING SAME

CROSS REFERENCE TO RELATED APPLICATIONS

This application is a divisional of U.S. Ser. No. 11/057,018 filed Feb. 11, 2005.

REFERENCE REGARDING FEDERALLY SPONSORED RESEARCH OR DEVELOPMENT

Not applicable

BACKGROUND OF THE INVENTION

1. Field of the Invention

The present invention relates generally to a trigger actuator for use with an aerosol container to aid in actuating the container.

2. Description of the Background of the Invention

Aerosol containers generally include a body portion where fluid is stored and an overcap portion having actuating means to disperse the fluid in aerosol form. The actuating means is generally pushed downwardly in order to disperse the aerosol upwardly. This downward motion is oftentimes difficult for the elderly or for those persons with disabilities, such as arthritis.

In some instances, an aerosol container may have a spray nozzle actuator having a resilient hinge portion, a nozzle pressing portion and a handle portion extending substantially parallel to the longitudinal extent of the can. The spray nozzle actuator is adapted for placement on an aerosol can having a spray nozzle. Pressure may be applied to the handle about the hinge, thereby forcing the nozzle pressing portion into direct contact with the spray nozzle. The force of the contact displaces the spray nozzle thereby resulting in the dispensing of liquid product in aerosol form from the can.

In other instances, an aerosol container may be in the form of a pressurized product dispenser having a container, a valve mechanism at the top of the container for discharging product upwardly, and a valve actuation lever pivotally connected to the valve mechanism. The valve actuation lever extends along a longitudinal axis of the container. Pressure may be applied to the lever such that the lever actuates the valve mechanism thereby releasing pressurized product from within the dispenser.

A trigger mechanism in some instances may be secured to a top end of an aerosol container for providing bias engagement of a discharge mechanism located thereon. The engagement facilitates discharge of fluid material from inside the aerosol container. The trigger mechanism includes a hinge connected to a trigger handle wherein the hinge allows the handle to be rotated upwardly to enable the handle to fit within a hollow removable top attached to the top of the aerosol container when not in use.

A clip on handle in some instances may attach to an overcap of an aerosol container. The handle includes a plurality of securing flanges, which are arranged to engage apertures provided in side walls of the overcap. The overcap further includes an elongate operating lever arm, which once the handle is clipped on to the overcap is pivoted toward the overcap and is moveable downward to press an actuator arm of the overcap.

SUMMARY OF THE INVENTION

According to one aspect of the present invention, a trigger actuator for a container includes a recess defined by one or more walls that protrude downwardly surrounding an actuating button of an overcap of the container. In one embodiment the trigger actuator is attached to the actuating button. The trigger actuator may further include an aperture disposed in the recess above an outlet and a lever disposed on the trigger actuator. Pressing the lever toward the container forces the walls defining the recess downward displacing the actuating button.

According to another aspect of the invention, a trigger actuator for a container includes a sleeve enclosing one or more portions of the container and/or one or more portions of an overcap disposed on the container. A lever is hingedly attached to a portion of the sleeve and an actuating member extends from the lever. In one embodiment, pressing the lever toward the container forces the actuating member downward displacing an actuating button of the container.

Other aspects and advantages of the present invention will become apparent upon consideration of the following detailed description. Like reference numerals in the drawings designate like structures in the various embodiments.

DESCRIPTION OF THE PREFERRED EMBODIMENTS

The present invention is directed to apparatuses, methods, kits, and combinations, for aiding in actuating a container. While the present invention may be embodied in many different forms, several specific embodiments are discussed herein with the understanding that the present disclosure is to be considered only as an exemplification of the principles of the invention, and it is not intended to limit the invention to the embodiments illustrated. For example, where the invention is illustrated herein with particular reference to an aerosol container, it will be understood that any other pressurized container, such as, for example, any package, usually a metal can or plastic bottle, designed to disperse the liquid contents thereof as a mist or foam, may if desired, be substituted in whole or in part for the aerosol container in the apparatuses, methods, kits, and combinations herein described.

It has been discovered that the trigger actuators described herein are unique assemblies exhibiting improved performance as container actuating mechanisms. Such trigger actuators exhibit improved functioning as actuating mechanisms including, for example, improved ease of use, while reducing and/or minimizing the amount of material required to produce an actuating mechanism.

Figures 1, 2, 3, 4:
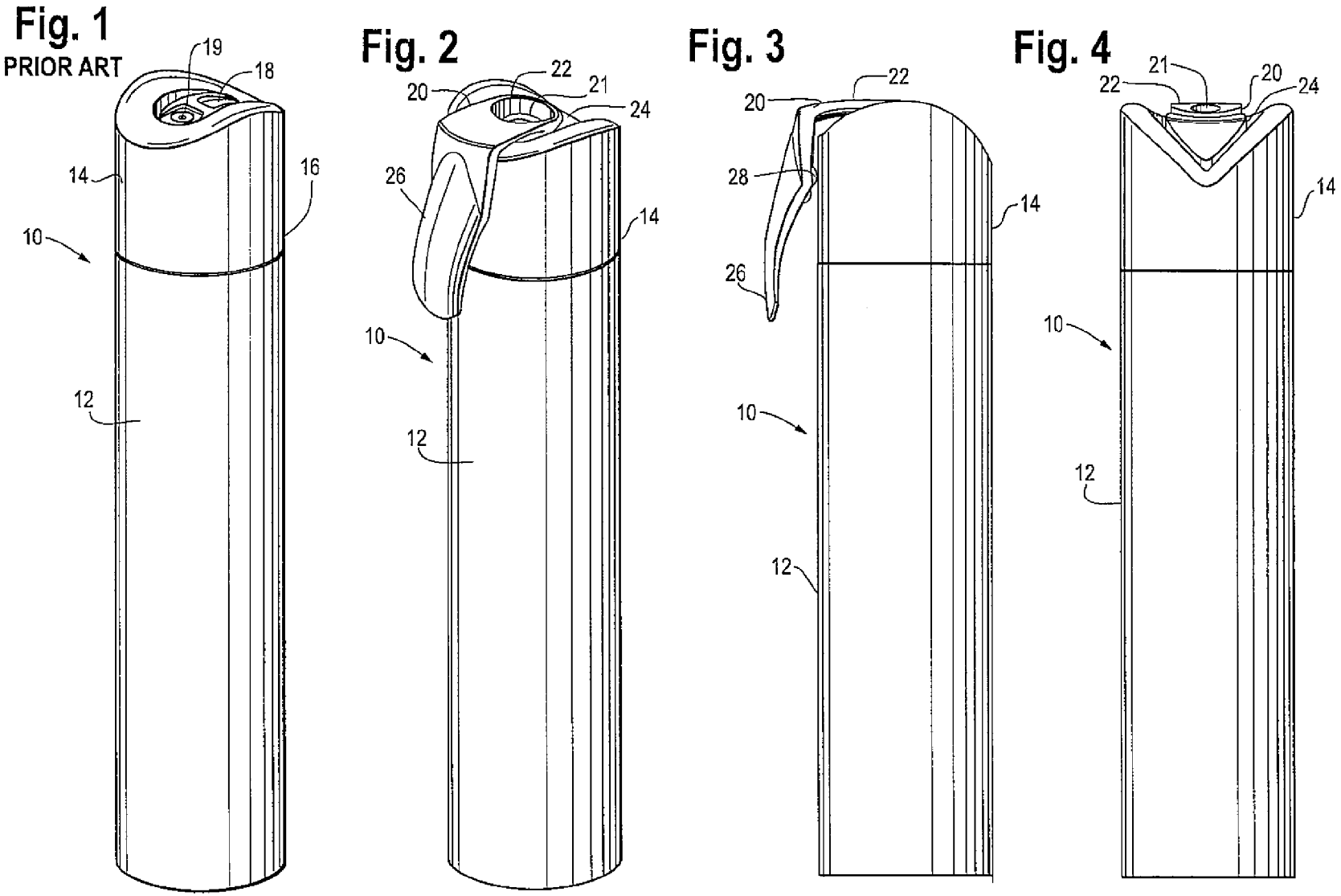
Fig. 1 PRIOR ART
FIG. 1 is an isometric view of a prior art aerosol container.
FIG. 2 is an isometric view of an aerosol container having a trigger actuator thereon, according to one embodiment of the present invention.
FIG. 3 is a side elevational view of the aerosol container of FIG. 2.
FIG. 4 is a front elevational view of the aerosol container of FIG. 2.

Referring now to the drawings, FIG. 1 depicts one type of aerosol container 10 known to those skilled in the art. The aerosol container 10 comprises a body 12 and an overcap 14 disposed at a top end 16 thereof. The overcap 14 further includes an actuating button 18, which is hingedly attached to the overcap 14. The actuating button 18 is pushed downwardly in order to disperse fluid contained in the body 12. Fluid is dispersed upward through an outlet 19 in the actuating button 18 and in a direction substantially parallel to a longitudinal axis of the aerosol container 10. In this embodiment, the outlet 19 is disposed on one side of the actuating button 18. Illustratively, the outlet 19 may be at an angle relative to a longitudinal axis of the aerosol container 10 to dispense contents of the aerosol container at an angle equal to or less than about 90° relative to the longitudinal axis of the aerosol container. In another embodiment, the angle of the outlet 19 dispenses the contents of the aerosol container 10 substantially parallel to the longitudinal axis of the aerosol container.

A first embodiment of a trigger actuator for use with an aerosol container 10 is indicated generally as 20 in FIGS. 2-8. As shown in FIG. 2, an aperture 21 is disposed within a recess of a top portion 22 of the trigger actuator 20. The aperture 21 is located above an outlet 19 in an actuating button 18 (FIG. 1) to allow dispersion therethrough. One or more walls, shown generally at 24, define the recess and protrude downwardly, surrounding the actuating button of the aerosol container 10. In one embodiment, the trigger actuator 20 is attached to the actuating button 18 that is hingedly attached to the overcap 14 of the aerosol container 10. In another embodiment, the trigger actuator 20 is attached to the actuating button 18 that is attached to the body 12 of the aerosol container 10.

A lever 26 is disposed on a side of the trigger actuator 20. Illustratively, the lever 26 is disposed on the same side of the aerosol container 10 as the outlet 19 (FIG. 1). The lever may protrude at any angle from the aerosol container 10 that is convenient to a user, and in this embodiment, protrudes somewhat perpendicularly from the top portion 22 of the trigger actuator 20. In one embodiment, the lever 26 is disposed at an angle of equal to or less than about 90° relative to a longitudinal axis of the aerosol container 10. In another embodiment, the lever 26 is disposed at an angle of equal to or greater than about 90° relative to a longitudinal axis of the aerosol container 10.

Pressing the lever 26 toward the aerosol container 10 forces the walls 24 defining the recess downward. This action displaces the actuating button 18 (FIG. 1) of the aerosol container 10 and disperses aerosolized liquid from inside the container. The aerosolized liquid further passes through the aperture 21 of the trigger actuator 20. As shown in FIG. 3, a protrusion 28 may extend from the lever 26 to abut the container 10 when the lever is pressed.

Figure 6:
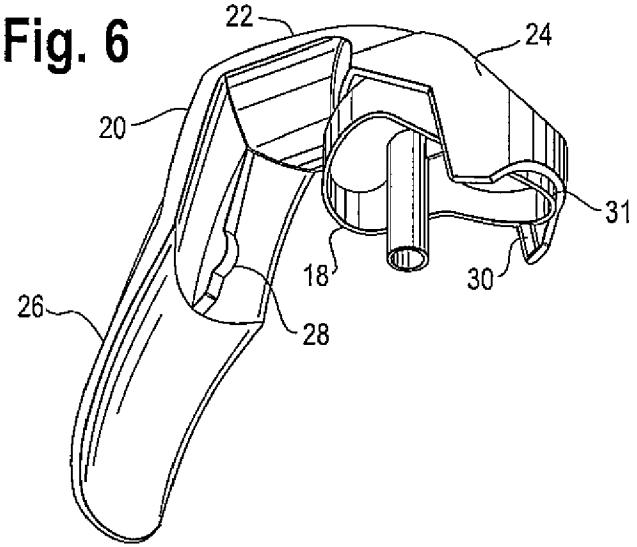
FIG. 6 is a further isometric view of the trigger actuator of FIGS. 2-5 disposed on an actuating button.
Figure 8:
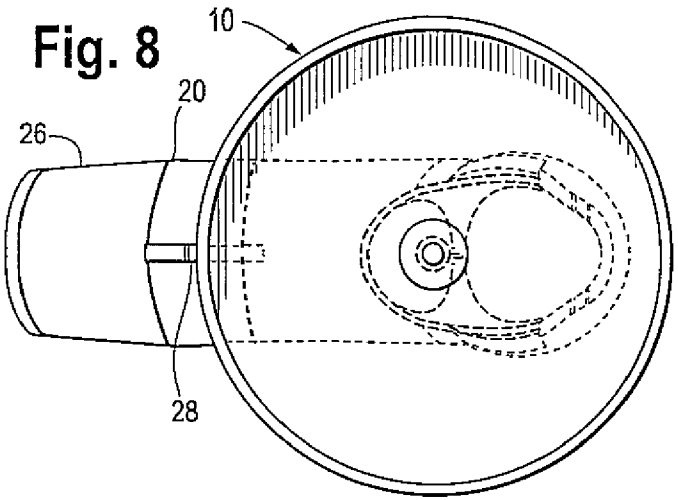
FIG. 8 is a bottom plan view of an aerosol container having a trigger actuator thereon, according to the embodiment of FIGS. 2-7.
Figure 5:
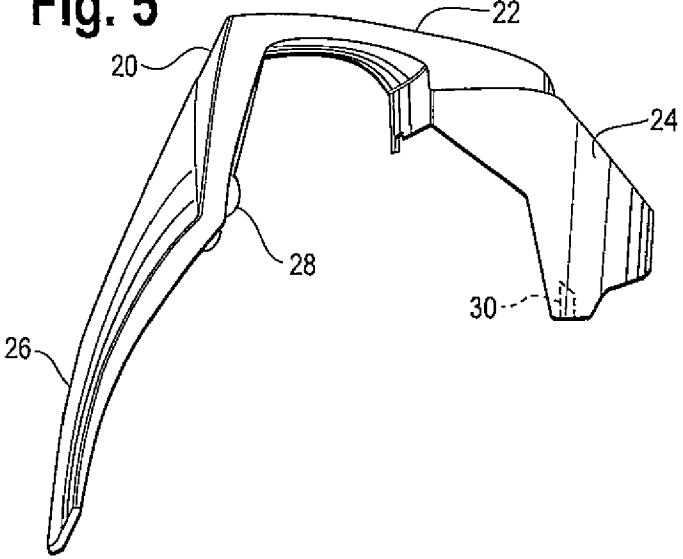
FIG. 5 is an isometric view of the trigger actuator of FIGS. 2-4.
Figure 7:
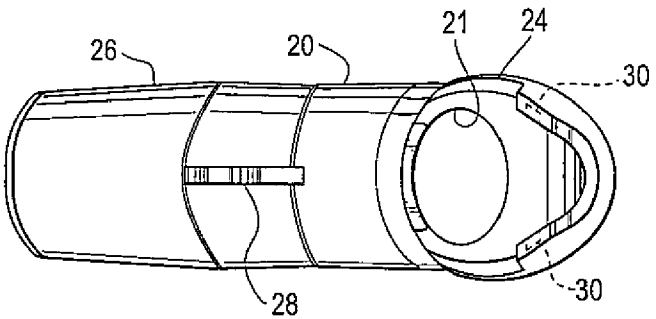
FIG. 7 is a bottom plan view of the trigger actuator of FIGS. 2-5.

As shown in FIG. 5, one or more protrusions 30 that extend somewhat perpendicularly from an inner portion of the walls 24. When the trigger actuator 20 is attached to an actuating button 18, as seen in FIG. 6, these protrusions 30 snap underneath the walls of the actuating button. The walls 24 may surround a portion or substantially all of the actuating button 18. It should be noted that the actuating button 18 of FIG. 6 is shown as having been removed from the overcap 14 (FIG. 1) at a portion 31, where it is normally hingedly secured to the overcap 14.

Figures 9, 10, 11, 12:
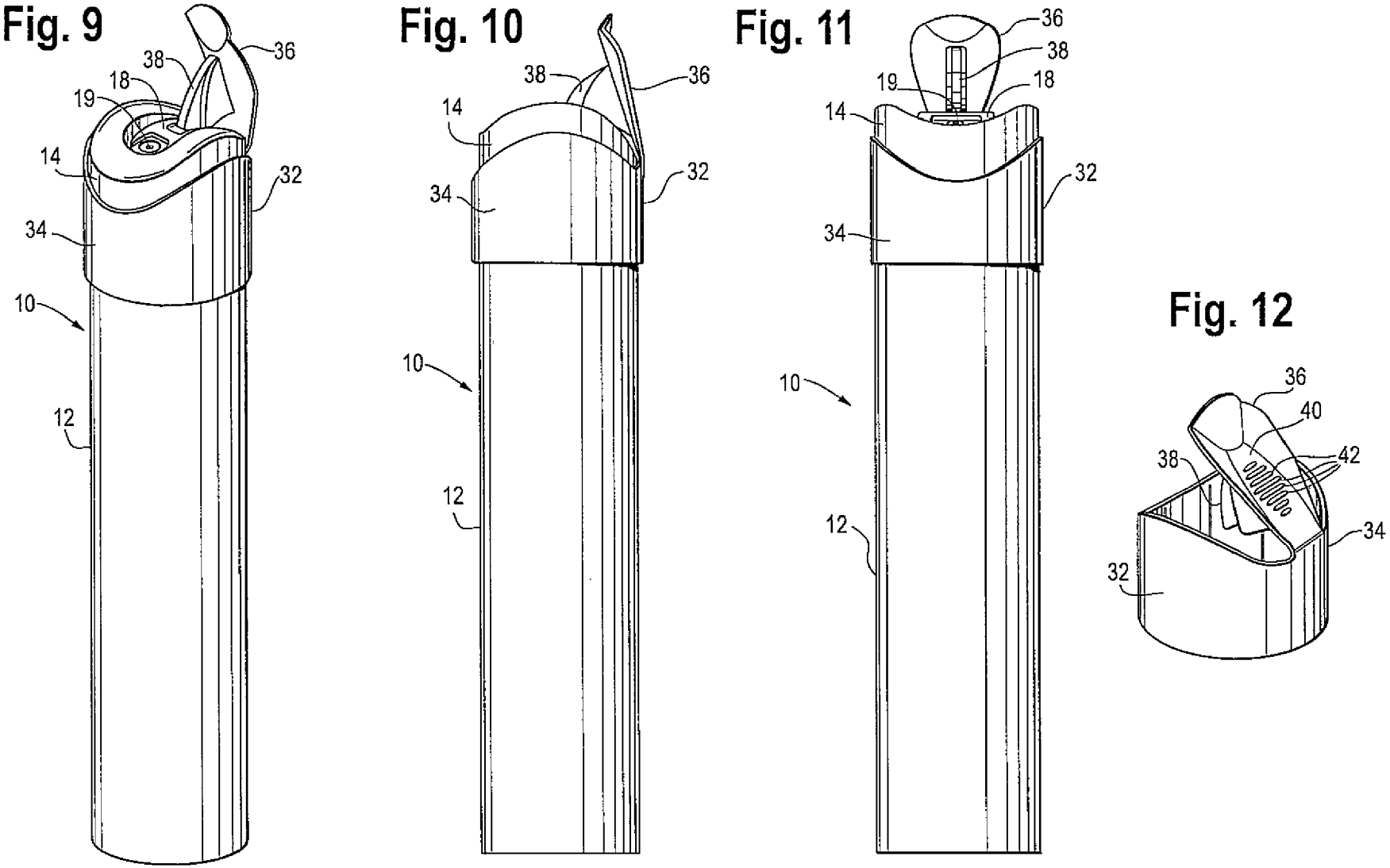
FIG. 9 is an isometric view of an aerosol container having a trigger actuator thereon, according to a further embodiment of the present invention.
FIG. 10 is a side elevational view of the aerosol container of FIG. 9.
FIG. 11 is a front elevational view of the aerosol container of FIG. 9.
FIG. 12 is an isometric view of the trigger actuator of FIGS. 9-11.
Figures 13, 14, 15, 16:
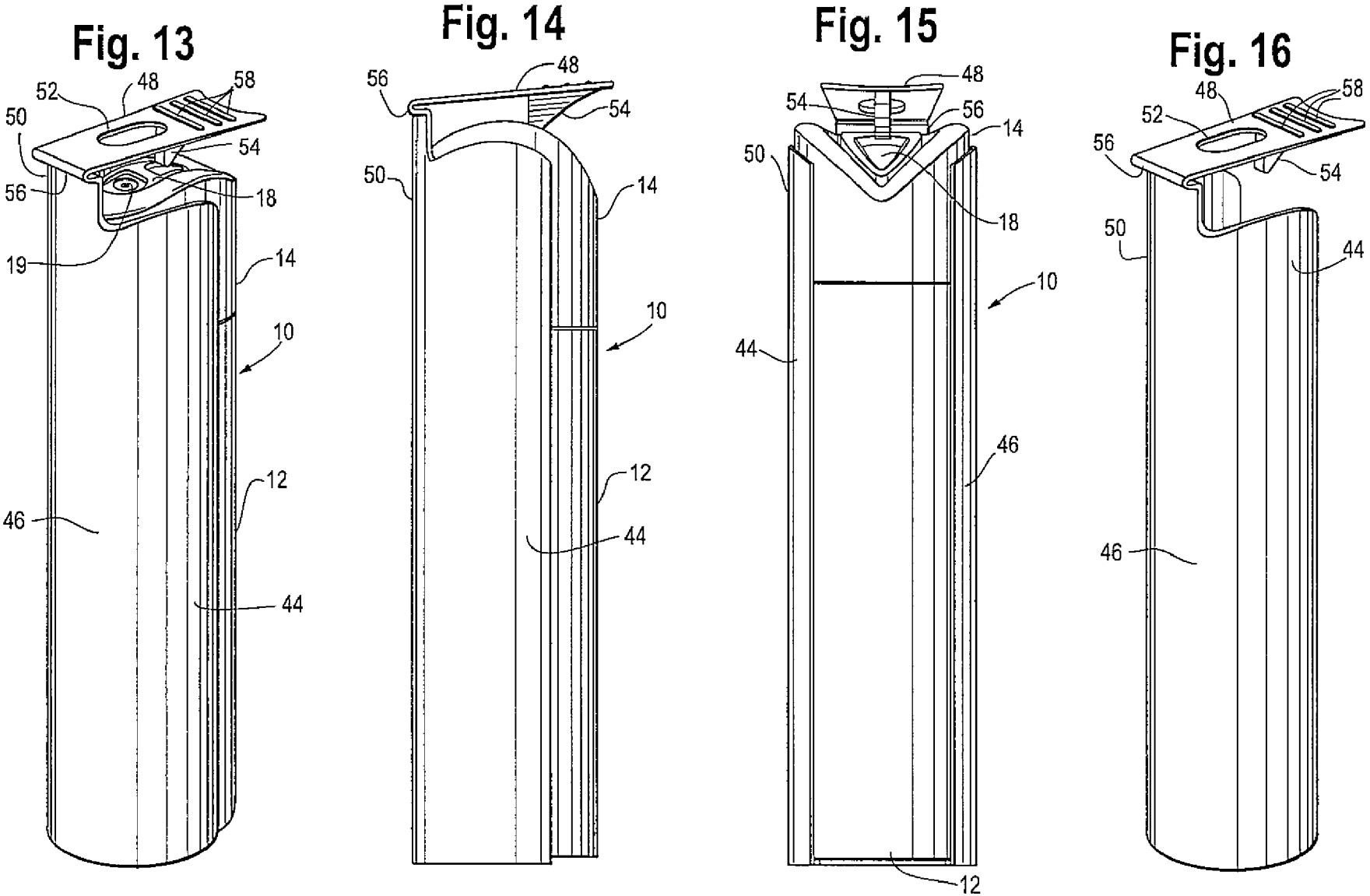
FIG. 13 is an isometric view of yet another embodiment of an aerosol container having a trigger actuator thereon.
FIG. 14 is a side elevational view of the aerosol container of FIG. 13.
FIG. 15 is a front elevational view of the aerosol container of FIG. 13.
FIG. 16 is an isometric view of the trigger actuator of FIGS. 13-15.

A further embodiment of a trigger actuator 32 for use with an aerosol container 10 is shown in FIGS. 9-11. In this embodiment of the present invention, the trigger actuator 32 includes a circumferential sleeve 34 for mounting onto an overcap 14 of the aerosol container 10. The sleeve 34 may extend partially around the circumference of the overcap 14 as shown, for example, in FIG. 10, or around substantially all of the circumference of the overcap 14 as shown in FIGS. 9, 11, and 12. Additionally, one or more portions of the sleeve 34 could also enclose one or more portions of the body 12 of the container 10. The trigger actuator 32 further includes a lever 36 extending upward from the sleeve 34 in a direction substantially parallel to a longitudinal axis of the aerosol container 10. In this embodiment, the lever 36 is disposed on the same side of the container 10 as the outlet 19. An actuating member 38 extends substantially perpendicular from the lever 36. Pressing the lever 36 toward the aerosol container 10 forces the actuating member 38 downward, thereby displacing the actuating button 18 of the container and causing discharge of the contents thereof.

As shown in FIG. 12, a back portion 40 of lever 36 may be indented to accommodate a user's finger(s) and may further include ridges 42 to assist in pressing the lever toward the aerosol container 10.

Another embodiment of a trigger actuator 44 for use with an aerosol container 10 is depicted in FIGS. 13-16. The trigger actuator 44 includes a sleeve 46 enclosing a portion of the aerosol container 10. Alternatively, the sleeve 46 could enclose substantially all or part of the entire circumference of the aerosol container 10 (not shown). Still further, the sleeve 46 could alternatively or in addition enclose substantially all or a portion of an overcap 14 of the aerosol container 10. A lever 48 is attached to a top portion 50 of the sleeve 46 and is disposed above the overcap 14 of the container 10. The lever 48 is substantially perpendicular to a longitudinal axis of the aerosol container 10. In this embodiment of the present invention, the lever 48 is attached to a portion of the sleeve 46 at hinge 56 on the same side of the aerosol container 10 as the outlet 19. The lever 48 includes an aperture 52 located above the outlet 19 to allow dispersion therethrough. An actuating member 54 extends perpendicularly from the lever 48. Pressing the lever 48 towards the aerosol container 10 forces the actuating member 54 downward, thereby displacing the actuating button 18 of the container. The lever 48 may additionally include one or more ridges 58 to assist in gripping the lever and pressing it toward the aerosol container 10.

In other embodiments of the present invention, a trigger actuator may have one or more recesses defined by one or more walls that protrude downwardly toward an actuating button of an overcap that is disposed on an aerosol container. The trigger actuator may be attached to one or more portions of the actuating button, including, for example, one or more interior and/or exterior portions of one or more side, bottom and/or top portions of the actuating button. An aperture in the actuating button is generally disposed in the recess above an outlet in the actuating button. A lever in one embodiment is disposed on a side and/or a top portion of the trigger actuator and by pressing the lever towards the aerosol container forces the walls defining the recess downward displacing the actuating button. Illustratively, a lever of the present invention may be disposed at an angle of between about 0° to about 180°, about 15° to about 135°, about 45° to about 105°, or about 60° to about 90°, relative to a longitudinal axis of the container. The lever may also be adapted and/or disposed at an angle so that by pressing the lever out wards from the aerosol container the actuating button is displaced.

In one embodiment of the present invention, the actuating button is hingedly attached to one or more interior and/or exterior portions of one or more side, bottom and/or top portions of an overcap disposed on an aerosol container.

A trigger actuator of the present invention may also include one or more walls that protrude downwardly partially surrounding or substantially surrounding one or more portions of the actuating button.

In one embodiment of the present invention, the outlet in the actuating button is at an angle relative to a longitudinal axis of the aerosol container to dispense the contents of the aerosol container at an angle of between about 0° to about 180°, about 15° to about 135°, about 45° to about 105°, or about 60° to about 90°, relative to a longitudinal axis of the container. In yet another embodiment, the angle of the outlet through which the contents of the aerosol container are dispensed is substantially parallel to the longitudinal axis of the aerosol container.

In yet another aspect of the present invention, a trigger actuator is provided that has one or more sleeves that surround or enclose one or more portions of an aerosol container including, for example, a portion or substantially all of a body and/or an overcap of the aerosol container. If the sleeve encloses a small portion of the container, fastening means, such as those discussed below, may be required to assist in securing the trigger actuator thereto. However, no additional fastening means are necessary if the sleeve encloses a more substantial portion of the container, such as, for example if over 50% of the circumference of the body and/or overcap is surrounded or enclosed.

In another embodiment of the invention, a lever is hingedly attached to one or more interior and/or exterior portions of one or more top, side, and/or bottom portions of the sleeve to facilitate actuation of the aerosol container an actuating member extends at an angle of, for example, between about 0° to about 180°, about 15° to about 135°, about 45° to about 105°, or about 60° to about 90°, relative to a longitudinal axis of the lever. In one embodiment, the actuating member extends substantially perpendicular to the lever. In another embodiment, the lever extends at an angle convenient for a user to actuate the container. Illustratively, a lever may extend at an angle between about 0° to about 180°, about 15° to about 135°, about 45° to about 105°, or about 60° to about 90°, relative to the longitudinal axis of the container. In one embodiment, a lever may extend substantially upward from the sleeve and run substantially parallel to a longitudinal axis of the container. In yet another embodiment, the lever is disposed above the overcap of the aerosol container and is substantially perpendicular to a longitudinal axis of the container. By pressing the lever toward the container, the actuating member is forced downward, thereby displacing an actuating button of the container.

In other embodiments of the present invention, the apparatuses, methods, kits, and combinations are directed to assisting a user in operating a trigger actuator of the present invention. For example, one or more exterior sidewalls and/or portions of the trigger actuator may be shaped to assist a user in gripping the trigger actuator. Such shapes include, for example, a concave shape (for example, U-shaped) and/or a convex shape. Additionally, one or more exterior side walls or portions of the trigger actuator may include one or more ribs, bulges, bumps, knobs, protrusions, distensions, and/or protuberances to assist a user in gripping one or more areas of the trigger actuator, including, for example, a lever of the trigger actuator. Illustratively, these gripping assists may be in any pattern, including, for example, horizontal, vertical, curved, serpentine, zigzag, and/or diagonal, to assist a user in gripping the trigger actuator. Combinations of the above gripping assists may also be used in the present invention.

Two or more surfaces described herein may be attached together in a permanent or non-permanent manner by any fastening, securing, and/or joining techniques known to those skilled in the art. Examples include mechanically, chemically, and/or heat fastening, securing, and/or joining together two or more surfaces of metal, plastic, glass, rubber, paper, and/or ceramic, and combinations thereof. A chemical agent useful in the present invention to fasten, secure, and/or join two or more surfaces together includes, for example, an adhesion promoter, a binding agent (for example, a cyanoacrylate adhesive, or an epoxy putty), a bonding agent (for example, a hot melt adhesive), a crosslinking agent, a curing agent (for example, a UV light curing adhesive), a fixative agent, a sticking agent, and/or a vulcanizing agent, and combinations thereof. Exemplary chemical agents useful in the present invention include those described in, for example, The Handbook of Industrial Chemical Additives—2nd Edition, Gower Publishing Limited (Mar. 28, 1998). Additional examples of chemical agents useful in the present invention include those described in the Merck Index, Thirteenth Edition, John Wiley & Sons, 13th edition (October 2001). Heat fastening, securing, and/or joining techniques useful in the present invention include, for example, ultrasound, heat or sonic staking, and/or laser welding or joining techniques. Mechanical techniques useful in the present invention, include, for example, the use of tabs, protrusions, hooks, clamps, fasteners, ties, fastening strips (for example, Velcro®), adhesive tape (for example, two sided tape), rivets, soldering, brazing, and/or welding, and combinations thereof. Combinations of the above fastening, securing, and/or joining techniques and agents may be used in the present invention.

A trigger actuator of the present invention may be constructed from, for example, multiple parts joined together, and/or the parts may be constructed to be snapped together. Alternatively, the trigger actuator may be an integral single piece. A trigger actuator of the present invention may be made from any suitable material including, for example, metal, glass, rubber, paper, ceramic and/or plastic such as, for example, nylon, polypropylene, polystyrene, acetal, toughened acetal, polyketone, polybutylene terephthalate, high density polyethylene, polycarbonate, and/or ABS, and combinations thereof.

A trigger actuator of the present invention may be made using any desired method known to those skilled in the art, including, for example, injection molding, a cast post applied process, and/or a blow molding process. Metallurgy techniques known to those skilled in the art are also useful in the present invention in making a trigger actuator described herein.

In other embodiments of the present invention, the apparatuses, methods, kits, and combinations are directed to assisting a user in operating a trigger actuator of the present invention. For example, in one embodiment one or more assists are used to help a user grip the trigger actuator. Such assists may be of any shape, such as, for example, a concave shape (for example, U-shaped) and/or a convex shape. Additionally, the trigger actuator may include one or more ribs, bulges, bumps, knobs, protrusions, distensions, and/or protuberances to assist a user in gripping the trigger actuator. Illustratively, a rib extending from a first portion of the trigger actuator to a second portion thereof may be in any pattern, including, for example, horizontal, vertical, curved, serpentine, zigzag, and/or diagonal, to assist a user in gripping the trigger actuator. Combinations of the above gripping assists may also be used in the present invention.

In yet another aspect, the present invention provides a kit containing a trigger actuator and an aerosol container. The trigger actuator of the kit may, for example, be configured to attach to an overcap of the aerosol container by attaching, for example, snapping, one or more pieces of the trigger actuator to the overcap. In yet another embodiment, the trigger actuator may be configured to be a removable attachment for the overcap. A set of instructions may also be included in a kit of the present invention instructing a user how to assemble the overcap to the cap and/or to disassemble the overcap from the cap, or how to attach and/or detach the trigger actuator from the overcap or aerosol container.

Although the embodiments shown herein illustrate the trigger actuator and actuating button at the upper end or top of a container, the present invention is intended to cover other arrangements in which, for example, the trigger actuator and actuating button are provided on one or more sides and/or on a bottom of a container.

INDUSTRIAL APPLICABILITY

The embodiments of the trigger actuator as described herein advantageously provide the consumer with a trigger actuator for use with an aerosol container that aids in actuating the container. This can be a particular advantage for a user who is handicapped, aged, or otherwise finds the actuation of a conventional aerosol can to be difficult.

The invention has been described in an illustrative manner, and it is to be understood that the terminology used is intended to be in the nature of description rather than of limitation. All patents and other references cited herein are incorporated by reference in their entirety. Many modifications, equivalents, and variations of the present invention are possible in light of the above teachings; therefore, it is to be understood that within the scope of the appended claims, the invention may be practiced other than as specifically described.

We claim:

1. A trigger actuator for a container, comprising:

a sleeve enclosing and in contact with at least a portion of an overcap disposed on the container, wherein the overcap includes an actuating button hingedly attached thereto and connected to a valve stem of the container;

a lever hingedly attached to a top portion of the sleeve and having a non-dispensing position in which the lever extends upward from the sleeve in a direction substantially parallel to a longitudinal axis of the container; and an actuating member extending substantially perpendicular from the lever, wherein pressing the lever towards the container forces the actuating member downward displacing the actuating button of the overcap.

2. The trigger actuator of claim 1, wherein the sleeve encloses at least 50% of the circumference of at least one of the body of the container or the overcap disposed on the container.

3. The trigger actuator of claim 1, wherein the container is an aerosol container and the trigger actuator comprises a removable attachment to the aerosol container.

4. The trigger actuator of claim 1, wherein the lever is made of a material comprising metal, glass, rubber, paper, ceramic or plastic, and combinations thereof, and includes one or more gripping assists.

5. The trigger actuator of claim 1, wherein the sleeve further encloses a substantial portion of the container.

6. The trigger actuator of claim 1, wherein the lever includes an aperture therethrough for movement of aerosolized particles therethrough.

7. The trigger actuator of claim 1, wherein the lever includes a plurality of ridges to assist in gripping the lever.

8. A method of actuating a container, the method comprising the steps of:

providing a trigger actuator for a container, the trigger actuator comprising a sleeve, a lever hingedly attached to a top portion of the sleeve and extending upward from the sleeve in a direction substantially parallel to a longitudinal axis of the container, and an actuating member extending substantially perpendicular from the lever and substantially perpendicular to the longitudinal axis of the container;

attaching the trigger actuator to a container having a valve stem and an overcap attached to the container, the overcap having an actuating button hingedly attached thereto for actuating the valve stem, wherein the sleeve of the trigger actuator is disposed around only the overcap; and pressing the lever toward the container forcing the actuating member downward, thereby displacing the actuating button on of the overcap.

9. The method of claim 8, wherein the container is an aerosol container.

10. The method of claim 8, wherein the pressing step causes particles to be released from the container.

11. The method of claim 10, wherein the sleeve encloses at least 50% of a circumference of the overcap.

12. The method of claim 10, wherein the sleeve encloses 100% of a circumference of the overcap.

13. A trigger actuator for a container, comprising:

a sleeve mounted to and enclosing at least a portion of an overcap disposed on the container, wherein the overcap includes an actuating button hingedly attached thereto and connected to a valve stem of the container;

a lever hingedly attached to a top portion of the sleeve and having a non-dispensing position in which the lever extends upward from the sleeve in a direction substantially parallel to a longitudinal axis of the container; and an actuating member extending substantially perpendicular from the lever, wherein pressing the lever toward the container forces the actuating member downward displacing the actuating button of the overcap.

14. The trigger actuator of claim 13, wherein the sleeve encloses at least 50% of a circumference of at least one of the body of the container or the overcap disposed on the container.

15. The trigger actuator of claim 13, wherein the sleeve is circumferential and is mounted to the overcap such that a circumference of the sleeve is in contact with a circumference of the overcap.

16. The trigger actuator of claim 13, wherein the sleeve, lever, and actuating member do not fully enclose the overcap.

17. The trigger actuator of claim 13, wherein the lever includes a plurality of ridges to assist in gripping the lever.

* * * * *

UNITED STATES PATENT AND TRADEMARK OFFICE

CERTIFICATE OF CORRECTION

PATENT NO. : 7,891,529 B2
APPLICATION NO. : 12/575956
DATED : February 22, 2011
INVENTOR(S) : Edward L. Paas et al.

It is certified that error appears in the above-identified patent and that said Letters Patent is hereby corrected as shown below:

Column 8, Line 46: replace “claim 10” with --claim 8--

Column 8, Line 48: replace “claim 10” with --claim 8--

Signed and Sealed this
Fourth Day of October, 2011

David J. Kappos

David J. Kappos
*Director of the United States Patent and Trademark Office*